US009682377B2

(12) United States Patent
Coulot et al.

(10) Patent No.: US 9,682,377 B2
(45) Date of Patent: Jun. 20, 2017

(54) METHOD FOR INJECTING MICROPARTICLES INTO A MICROFLUIDIC CHANNEL

(71) Applicant: MYCARTIS NV, Zwijnaarde/Ghent (BE)

(72) Inventors: Laurent Coulot, Aire-le-Lignon (CH); Nicolas Demierre, Chatel-St-Denis (CH); Raphael Tornay, Illarsaz (CH)

(73) Assignee: MYCARTIS NV, Zwijnaarde/Ghent (BE)

( * ) Notice: Subject to any disclaimer, the term of this patent is extended or adjusted under 35 U.S.C. 154(b) by 162 days.

(21) Appl. No.: 14/413,518

(22) PCT Filed: Jul. 2, 2013

(86) PCT No.: PCT/EP2013/063966
§ 371 (c)(1),
(2) Date: Jan. 8, 2015

(87) PCT Pub. No.: WO2014/009210
PCT Pub. Date: Jan. 16, 2014

(65) Prior Publication Data

US 2015/0190807 A1 Jul. 9, 2015

(30) Foreign Application Priority Data

Jul. 11, 2012 (EP) ..... 12175903

(51) Int. Cl.
*B01L 3/00* (2006.01)
*B01L 9/00* (2006.01)

(52) U.S. Cl.
CPC ..... *B01L 3/502761* (2013.01); *B01L 3/50273* (2013.01); *B01L 3/502715* (2013.01); *B01L 9/527* (2013.01); *B01L 2200/027* (2013.01); *B01L 2200/0647* (2013.01); *B01L 2300/0858* (2013.01); *Y10T 436/2575* (2015.01)

(58) Field of Classification Search
CPC ..... B01L 3/502761; B01L 3/35027; B01L 3/502; B01L 3/50; B01L 19/0046; B01L 19/00; Y10T 436/2575; Y10T 436/25
USPC ..... 422/502, 501, 500, 50; 436/180, 174
See application file for complete search history.

(56) References Cited

U.S. PATENT DOCUMENTS

| | | | | |
|---|---|---|---|---|
| 2008/0102469 | A1 | 5/2008 | Kajiyama et al. | 435/6 |
| 2011/0306506 | A1 | 12/2011 | Demierre et al. | 506/7 |

FOREIGN PATENT DOCUMENTS

| | | | |
|---|---|---|---|
| DE | 2464300 | 4/2010 | B01L 3/00 |
| EP | 2 484 447 | 8/2012 | B01L 3/00 |
| WO | WO 00/63695 | 10/2000 | G01N 33/532 |
| WO | WO 2010/072011 | 7/2010 | B01L 3/00 |
| WO | WO 2011/067670 | 6/2011 | |

OTHER PUBLICATIONS

International Search Report for International Application No. PCT/EP2013/063966, Nov. 7, 2013.

*Primary Examiner* — Christine T Mui
(74) *Attorney, Agent, or Firm* — Kusner & Jaffe

(57) ABSTRACT

The present invention relates to a method for injecting microparticles into a microfluidic channel by means of injecting means, said microfluidic channel opening out on a sidewall of an inlet well, the method comprising the steps of: a) positioning the injecting means tip above said sidewall and at a predetermined distance (d) therefrom, and b) injecting the microparticles into said inlet well so that they come into contact with said sidewall during injection, the sidewall being tilted so that at least a portion of the microparticles included in the injected liquid sample slides on the sidewall and enters the microfluidic channel.

16 Claims, 3 Drawing Sheets

METHOD FOR INJECTING MICROPARTICLES INTO A MICROFLUIDIC CHANNEL

FIELD OF THE INVENTION

The invention relates to a method for injecting microparticles, in particular microcarriers such as encoded microcarriers, into a microfluidic channel by means of injecting means.

BACKGROUND OF THE INVENTION

Within the scope of the present invention, the term microfluidic channel refers to a closed channel, i.e. an elongated passage for fluids, with a cross-section microscopic in size, i.e. with the largest dimension of the cross-section being typically from about 1 to about 500 micrometers, preferably about 10 to about 300 micrometers. A microfluidic channel has a longitudinal direction, that is not necessarily a straight line, and that corresponds to the direction in which fluids are flowing within the microfluidic channel, i.e. preferably essentially to the direction corresponding to the average speed vector of the fluid, assuming a laminar flow regime.

A microcarrier or a microparticle refers to any type of particles, respectively to any type of carriers, microscopic in size, typically with the largest dimension being from 100 nm to 300 μm, preferably from 1 μm to 200 μm.

According to the present invention, the term microcarrier refers to a microparticle functionalized, or adapted to be functionalized, that is containing, or adapted to contain, one or more ligands or functional units bound to the surface of the microcarrier or impregnated in its bulk. A large spectrum of chemical and biological molecules may be attached as ligands to a microcarrier. A microcarrier can have multiple functions and/or ligands. As used herein, the term functional unit is meant to define any species that modifies, attaches to, appends from, coats or is covalently or non-covalently bound to the surface of said microcarrier or impregnated in its bulk. These functions include all functions that are routinely used in high-throughput screening technology and diagnostics.

Drug discovery or screening and DNA sequencing commonly involve performing assays on very large numbers of compounds or molecules. These assays typically include, for instance, screening chemical libraries for compounds of interest or particular target molecules, or testing for chemical and biological interactions of interest between molecules. Those assays often require carrying out thousands of individual chemical and/or biological reactions.

Numerous practical problems arise from the handling of such a large number of individual reactions. The most significant problem is probably the necessity to label and track each individual reaction.

One conventional method of tracking the identity of the reactions is achieved by physically separating each reaction in a microtiter plate (microarray). The use of microtiter plates, however, carries several disadvantages like, in particular, a physical limitation to the size of microtiter plates used, and thus to the number of different reactions that may be carried out on the plates.

In light of the limitations in the use of microarrays, they are nowadays advantageously replaced by functionalized encoded microparticles to perform chemical and/or biological assays. Each functionalized encoded microparticle is provided with a code that uniquely identifies the particular ligand(s) bound to its surface. The use of such functionalized encoded microparticles allows for random processing, which means that thousands of uniquely functionalized encoded microparticles may all be mixed and subjected to an assay simultaneously. Examples of functionalized encoded microparticles are described in the international patent application WO 00/63695 and are illustrated in FIG. 1.

The international patent application WO 2010/072011 describes an assay device having at least one microfluidic channel which serves as a reaction chamber in which a plurality of functionalized encoded microparticles or microcarriers can be packed. Typically, such a microcarrier 1, illustrated in FIG. 1, comprises a body 2 having a shape of a right circular cylinder or disc delineated by a first circular surface 3 and a second circular surface, not shown, opposite to the first circular surface 3. Such a microcarrier 1 is usually encoded by a distinctive mark attached to it for its identification. The distinctive mark may comprise a distinctive pattern of a plurality of traversing holes 4 and may also include an asymmetric orientation mark 5 such as, for example, a L-shaped sign or a triangle, as shown in FIG. 1. This asymmetric orientation mark 5 allows the distinction between the first circular major surface 3 and the second circular major surface.

The microfluidic channel of the assay device described in WO 2010/072011 is provided with stopping means acting as filters that allow a liquid solution containing chemical and/or biological reagents to flow through while blocking the microcarriers 1 inside. The geometrical height of said microfluidic channel and the dimensions of said microcarriers are chosen so that said microcarriers 1 are typically arranged in a monolayer arrangement inside each microfluidic channel preventing said microcarriers 1 to overlap each other.

The European patent application EP11000970.1 describes an encoded microcarrier 6 as shown in FIG. 2, the first circular surface 3 of said microcarrier 6 comprising a detection surface 8 to detect a chemical and/or biological reaction and further comprising protruding means 7 which are shaped to ensure that, when the encoded microcarrier 6 is laid on a flat plane with the detection surface 8 facing said flat plane, a gap exists between said flat plane and this detection surface.

The detection of a reaction of interest can be based on continuous readout of the fluorescence intensity of each encoded microcarrier present in a microfluidic channel of an assay device. The presence of a target molecule in the assay will trigger a predetermined fluorescent signal which is detected through a transparent observation wall of the assay device. When an encoded microcarrier is injected in the microfluidic channel, its detection surface is intended to face said observation wall and a laminar flow of liquid (containing chemical and/or biological reagent of interest for the assay) is intended to pass through the above-mentioned gap between said detection surface and the observation wall. Thanks to this laminar flow of liquid in the gap, the microcarrier presents a more homogeneous reaction of interest on its detection surface.

As shown in FIG. 3, the microcarriers 6 are prepared in suspension in a liquid sample 16 which is injected in a microfluidic channel 13 via an inlet well 14 having a sidewall 15 on which opens out an end of the microfluidic channel 13. The bottom wall 17 of the inlet well 14 is connected to a microfluidic channel bottom wall 18 which comprises the above-mentioned observation wall 10.

In the prior art, the liquid sample 16 is injected in the microfluidic channel 13 by injecting means which has a tip 19 through which the liquid sample is intended to exit when being injected, said tip 19 being inserted into the inlet well 14 during injection. During said injection, the liquid sample 16 comes into contact with the bottom wall 17 of the inlet well 14, and the microcarriers 6 deposit by sedimentation from the tip 19 until they land on the bottom wall 17 of the inlet well 14. The detection of the presence of molecules bound to the detection surfaces 8 is only possible when said detection surfaces 8 face the observation wall 10, as shown by a first microcarrier 11 in the FIG. 4. However, during sedimentation, the microcarriers 6 may flip over so that some of the microcarriers 6 present their detection surface 8 opposite to the observation wall 10 of the microfluidic channel 13, as a second microcarrier 12 shown in FIG. 4. Thus, the second microcarrier 12 presenting a wrong orientation of its detection surface cannot emit any detectable signal and can be considered as false negative during the biological assay. Moreover, the fluid flow, represented by the arrows B is disturbed by the second microcarrier 12, which does not present a spacing 9 between its detection surface 8 and the observation wall 10. Indeed, in the absence of the spacing 9, the velocity of the fluid flow is very low in the vicinity of the wall 10. The velocity field of the fluid flow is then inhomogeneous in the microfluidic channel 13 which led to an inhomogeneous distribution of the reagents and target molecules intended to interact with the detection surfaces 8 of the first microcarrier 11 (since the reagents are not renewed in the fluid flow portions where the velocity is very low). Thus, it is of major importance to prevent the problem of the wrong orientation of the microcarriers within the microfluidic channel for performing a reliable biological assay for research and clinical laboratories.

SUMMARY OF THE INVENTION

The present invention aims to remedy all or part of the disadvantages mentioned above.

To this aim, the invention proposes a method for injecting microparticles into a microfluidic channel by means of injecting means which comprises a tip through which said microparticles are intended to exit when being injected, said microfluidic channel having an end opening out on a sidewall of an inlet well, and the microparticles comprising a top side and a bottom side which comprises protruding means, wherein the method comprises the steps of:

a) positioning said tip above at least a zone of said sidewall and at a predetermined distance therefrom, and
b) injecting the microparticles into said inlet well so that the microparticles come into contact with or in the vicinity of said zone, said sidewall being non-horizontal and non-vertical during injection so that at least a portion of the injected microparticles slides on the sidewall and enters said end of the microfluidic channel with their bottom sides facing a bottom wall of the microfluidic channel.

The microparticles are preferably in suspension in a liquid sample. In this case, the injecting means comprise the liquid sample including the microparticles. During injection, at least a portion of the liquid sample may be injected into the inlet well simultaneously with the microparticles. In a variant, substantially no liquid sample exits from the tip and is injected in the inlet well, the microparticles exiting from the tip and entering into the inlet well only by sedimentation ("sedimentation" means that the microparticles fall by gravity, without necessarily the need of being driven by a fluid flow comprising said microparticles). The microchannel and the inlet well may be previously filled in with a liquid fluid which may have a composition and/or a viscosity which are substantially the same as those of the liquid sample.

Thus, in the method according to the invention, the tip of the injecting means is located precisely with respect to the sidewall of the inlet well, the distance d therebetween being predetermined for example in function of the size of the microparticles, the viscosity of the liquid sample, the concentration of microparticles within the liquid sample and/or the size of the exit orifice of the injecting means tip. Preferably, the injecting means is located above a zone of the sidewall which is located between said tip and said end (entrance) of the microfluidic channel. The tip of the injecting means, the above-mentioned zone of the sidewall and the end of the microfluidic channel may be substantially coplanar.

Said predetermined distance d may be in the range 0.5 to 5 mm, preferably 0.5 to 4 mm, and more preferably 1 to 3 mm.

The liquid sample is (or the microparticles are) intended to come into contact with the sidewall of the inlet wall which is the contrary of the prior art method. Moreover, according to the invention, said sidewall is inclined with respect to vertical and horizontal planes so that the microparticles may slide on the sidewall, in particular by gravity.

Before landing or settling on the sidewall of the inlet well, the microparticles contained in the injected liquid sample fall by sedimentation after exiting from the injecting means tip. During sedimentation, the microparticles rotate and then land on the inlet well sidewall. The rotation of the microparticles is namely due to their shape. Due to the presence of the protruding means on their bottom sides, the microcarriers are not symmetrical about a plane perpendicular to their longitudinal axis. The rotation of the microparticles may occur about their centers of gravity.

The inventors have identified that the above-mentioned distance d between the tip of the injecting means and the sidewall of the inlet well can be optimized to ensure that at least a portion of the microparticles, and surprisingly most of the microparticles, slide on the sidewall and enter the microfluidic channel with their bottom sides comprising the protruding means facing the bottom wall of the microfluidic channel. The invention allows therefore increasing notably the ratio of microparticles having a correct orientation, i.e., having their bottom sides facing the bottom wall of the microfluidic channel so that the protruding means of these bottom sides may define spacings as mentioned above and that the detection surfaces of the microparticles may face an observation wall of the microfluidic channel.

Preferably, the injecting means comprise a liquid sample in which the microparticles are in suspension, the liquid sample comprising a concentration of microparticles of less than 2000, and preferably less than 1000, microparticles per milliliter of liquid sample. This low concentration allows reducing the risks of interactions (in particular hydrodynamic interactions) between the microparticles during the sedimentation, which interactions may limit rotating of the microparticles. Advantageously, the injection of microparticles or liquid sample is performed so that the microparticles land substantially one by one on the sidewall.

The injecting means may be moved during injection of the microparticles or liquid sample so as to facilitate the deposit of the microparticles on the sidewall.

At step a), the injecting means may be positioned so that the angle between their longitudinal axis and the sidewall or a longitudinal axis of the sidewall is between 0 to 30°. In an embodiment, the injecting means are substantially parallel to the (longitudinal axis of the) sidewall.

The sidewall of the inlet well may be inclined at an angle of about 10 to 80°, preferably 20-70° and more preferably 50-70°, with respect to a horizontal plane. This angle can be determined so as to limit or avoid the wall effects when the microparticles are deposited on the sidewall.

The bottom wall of the microfluidic channel is preferably connected to a bottom wall of the inlet well.

The microparticles may be microcarriers and for example encoded microcarriers.

The microfluidic particles may have a disc shape and have a diameter of about 1 to 200 μm and a height of about 1 to 50 μm.

The microfluidic channel has a height which is preferably less than the diameter and less than twice the thickness of the microparticles so as to avoid any reorientation of the microparticles within the microfluidic channel.

The present invention also proposes a device for performing the above method, which comprises an assay device comprising at least one microfluidic channel each opening out on a sidewall of an inlet well and having a bottom wall connected to a bottom wall of the inlet well, and a loading station carrying the assay device in a tilted position where the angle between the assay device and a horizontal plane is about 10-80°, preferably about 20-70°, and more preferably about 20-40°, so that said inlet well is located above said at least one microfluidic channel. This angle is for example of about 30°.

BRIEF DESCRIPTION OF THE DRAWINGS

The invention can be better understood and other details, features, and advantages of the invention appear on reading the following description made by way of non-limiting examples with reference to the accompanying drawings, in which.

DETAILED DESCRIPTION OF THE INVENTION

A method according to the invention is shown in FIGS. 5 to 8 which illustrate steps of this method.

Figure 1:
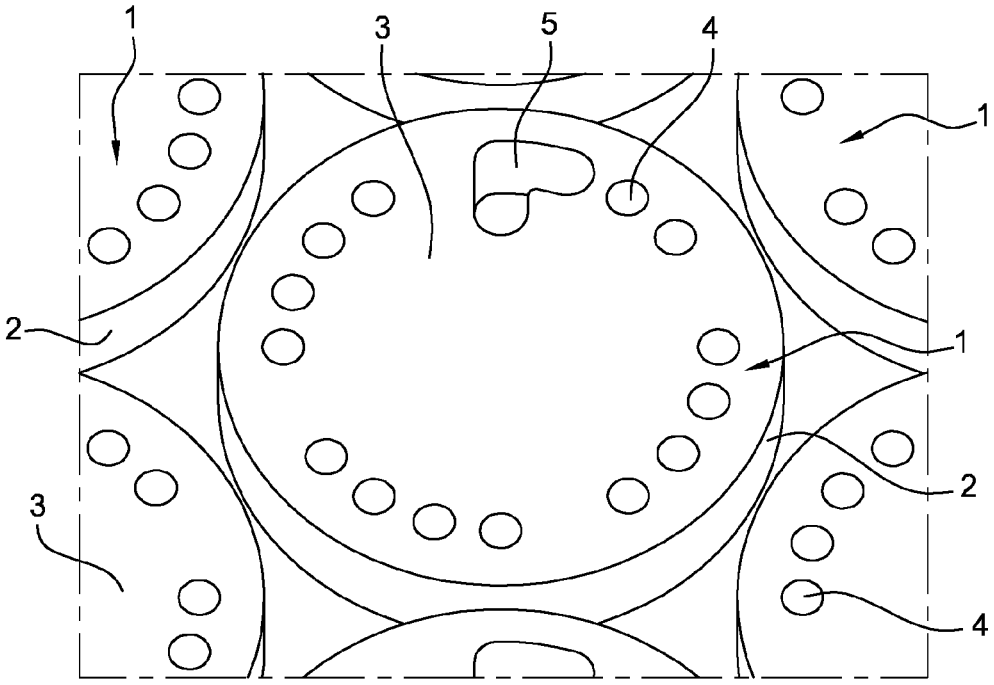
FIGS. 1 and 2 illustrate top perspective views of microcarriers according to the prior art.
Figure 2:
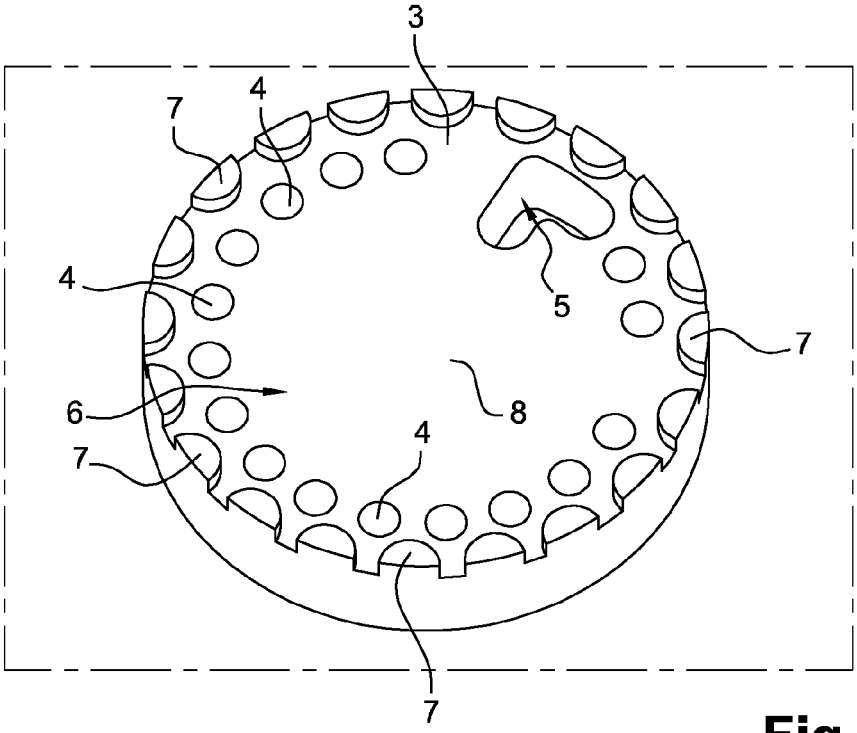
Figure 3:
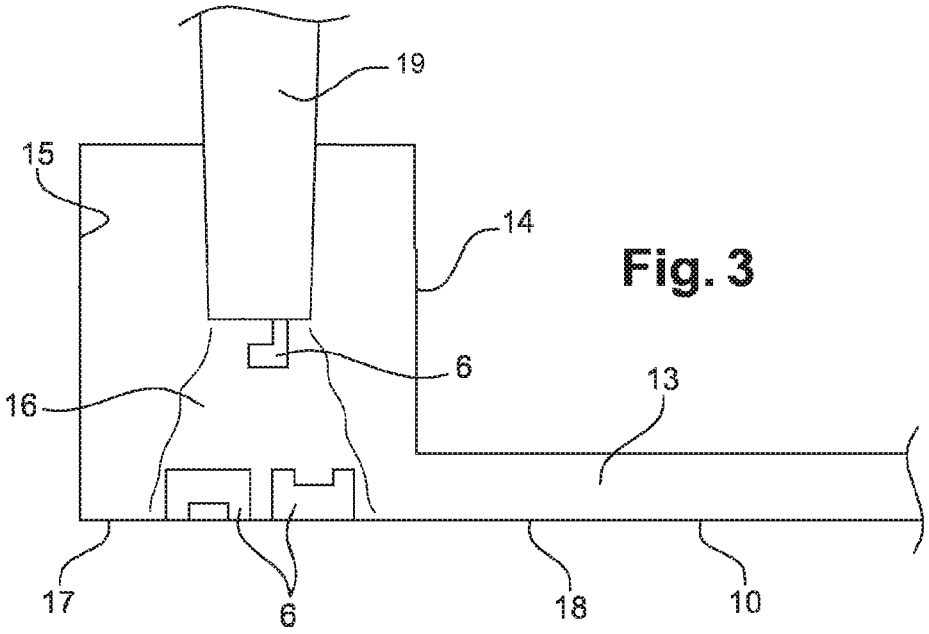
FIG. 3 shows a cross-sectional view of an inlet well and a microfluidic channel into which is injected a liquid sample comprising microparticles, according to a prior art method.
Figure 4:
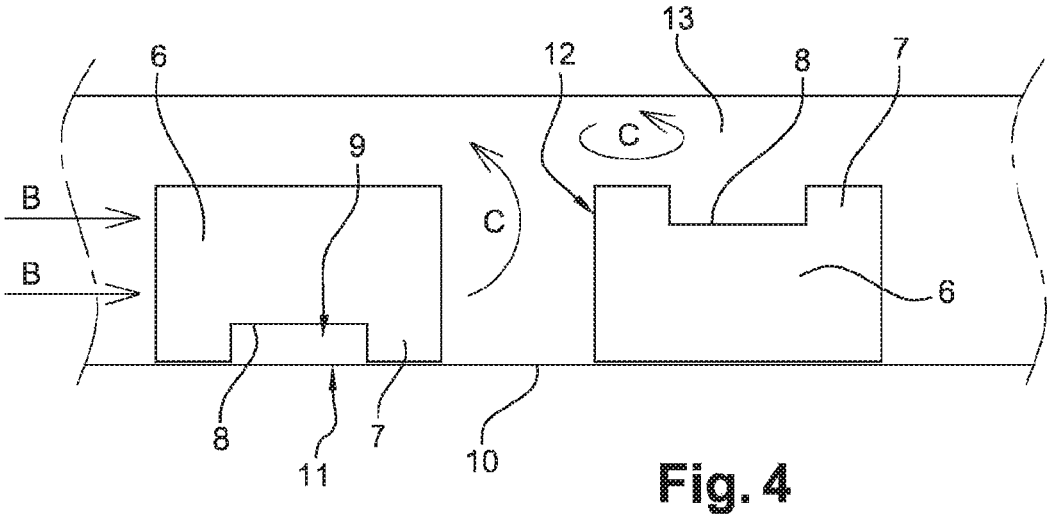
FIG. 4 shows a cross-sectional view of a microfluidic channel comprising microparticles therein.
Figure 5:
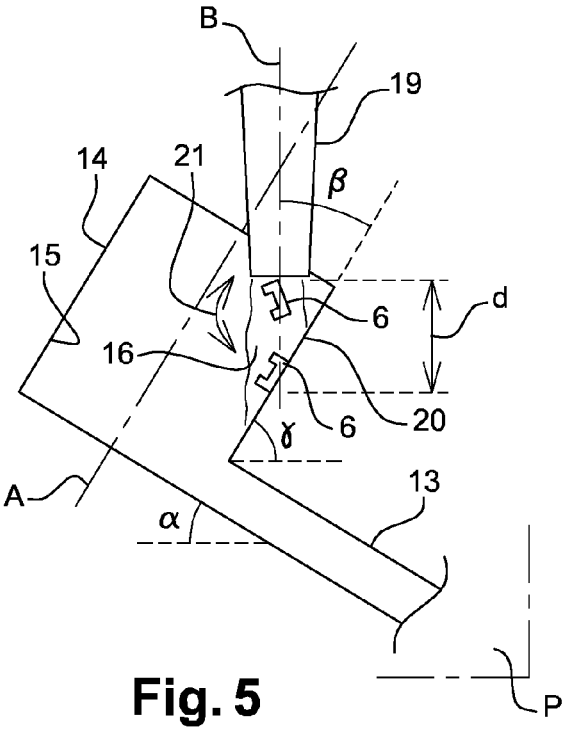
FIG. 5 shows a cross-sectional view of an inlet well and a microfluidic channel into which is injected a liquid sample comprising microparticles, according to the invention.

The first step or injecting step shown in FIG. 5 differs from the injecting step shown in FIG. 3 at least in that the assay device (comprising at least one microchannel 13 having an end opening out on a sidewall 15 of an inlet well 14) is tilted with respect to a horizontal plane. The angle α between the assay device (or the bottom walls 17, 18 of the inlet well 14 and of the microfluidic channel 13) and a horizontal plane is for example of about 30°.

As shown in FIG. 5, the inlet well 14 is located substantially above the microfluidic channel 13 so that the liquid sample to be injected therein can deposit by sedimentation in the inlet well and slide in the microfluidic channel by gravity.

In the example shown, the inlet well 14 has a substantially cylindrical shape and its sidewall 15 is therefore a substantially cylindrical surface and has a longitudinal axis A which is substantially perpendicular to the longitudinal axis of the microfluidic channel 13. The angle γ between the longitudinal axis A and a horizontal plane is here of about 60°.

The liquid sample 16 is injected in the inlet well 14 and the microfluidic channel 13 by injecting means which comprises for example a pipette or a microsyringe having an end carrying a tip 19 such as a disposable tip. The liquid sample 16 is intended to be drawn up in the tip which is then intended to be inserted in the inlet well 14 so as to eject the microparticles 6 therein.

As mentioned above, the liquid sample 16 comprises microparticles 6 which can be microcarriers such as encoded microcarriers. These microparticles 6 have for example a disc-shape and each comprise a top side and a bottom side, said bottom side comprising protruding means as described above, i.e., means intended to create a gap when the bottom side faces a planar wall. The protruding means are intended to be in abutment against said planar wall so as to define said gap between the planar wall and its bottom wall, said gap having a thickness which is substantially equal to the height of the protruding means.

According to the invention, the microparticles 6 are intended to be injected on the sidewall of the inlet well 14 as shown in FIG. 5. This is achieved by positioning the tip 19 of the injecting means above a zone 20 of the inlet well sidewall 15 and at a predetermined distance d therefrom. As will be explained below, the microparticles 6 are intended to slide on the sidewall 15 by gravity until they reach the entrance of the microfluidic channel 13, i.e., the end of the microfluidic channel 13 opening out on the sidewall 15.

The zone 20 of the sidewall 15 on which the liquid sample 16 is deposited is situated above the entrance of the microfluidic channel 13, and is preferably coplanar with said entrance and the injecting means tip 19. In the example shown, the plane of the drawings sheet of FIG. 5 is the plane P passing through the longitudinal axes of the sidewall 15 and of the microfluidic channel 13. The above-mentioned zone 20 is located in said plane P on the same side as the entrance of the microfluidic channel 13.

The sedimentation distance d is predetermined so that the microparticles 6 can rotate during sedimentation and land on the sidewall with their top side facing the sidewall 15. As shown in FIG. 5, each microparticle 6 exiting the injecting means tip 19 rotates (arrow 21) and deposits by sedimentation on the sidewall zone 20 as explained above. The inventors have discovered that the distance d can be accurately defined so as to ensure that most of the microparticles 6 land on the sidewall 15 with their top side facing the sidewall 15. Once into contact with the sidewall 15, the microparticles 6 slide thereon while keeping their orientation.

In a particular embodiment of the invention where the inlet well 14 has a diameter of about 5 mm and a height of about 7 mm, the microparticles have a diameter of about 30 μm and a height of about 10 μm, and the microfluidic channel 13 has a height of about 16 μm, the distance d is about 3 mm.

The longitudinal axis B of the tip 19 of the injecting means is inclined with respect to a horizontal plane and is in particular substantially parallel to the sidewall 15 or its longitudinal axis A. The angle β between the longitudinal axes of the injecting means tip 19 and of the sidewall 15 may be equal to the angle γ.

Figure 6:
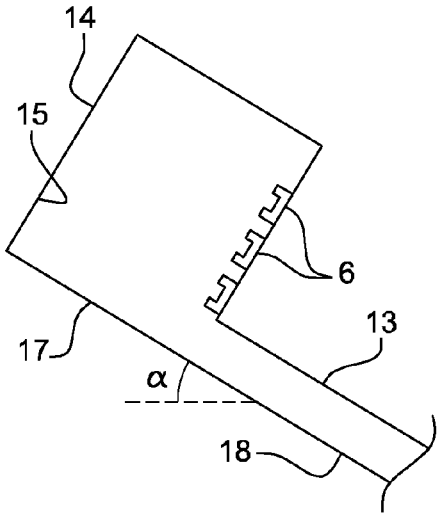
FIGS. 6 to 8 show cross-sectional views of the inlet well of FIG. 5 and illustrate the movement of the microparticles from the inlet well to the microfluidic channel.
Figure 7:
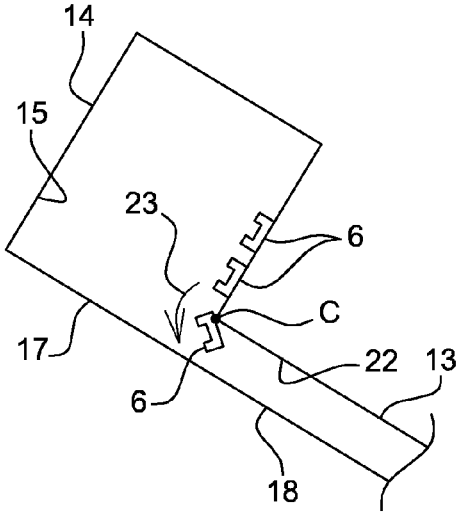

The interactions, i.e., the hydrodynamic interactions, between the microparticles 6 during the sedimentation may have an influence on their orientation and may limit the above-mentioned rotation. It may therefore be advantageous to limit these interactions. This may be achieved by injecting the microparticles 6 in the inlet well 14 substantially one by one, as schematically shown in FIGS. 5 and 6. It is possible to use a liquid sample with a low concentration of microparticles so as to limit said interactions.

The microparticles 6 injected in the inlet well 14 slide on the sidewall 15 until they reach the entrance of the microfluidic channel 13. Before entering the microfluidic channel 13, the microparticles rotate about a center C located substantially at the connection zone between the ceiling 22 of the microfluidic channel 13 and the sidewall 15 (arrow 23). After rotating, the microparticles 6 land on the bottom wall 18 of the microfluidic channel 13 with their bottom sides facing this bottom wall.

Figure 8:
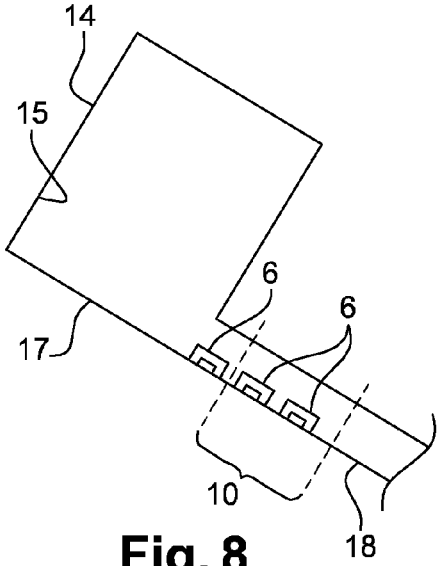

The invention ensures that most of the microparticles have their bottom sides comprising the protruding means which face the bottom wall 18 of the microfluidic channel 13. As shown in FIG. 8, all the microparticles 6 have a correct orientation, their bottom sides facing the observation wall 10 of the microfluidic channel bottom wall and all defining a gap into which a laminar flow of liquid can pass. Thanks to this laminar flow of liquid, the microparticles 6 may present more homogeneous reactions of interest on their detection surfaces located on their bottom sides. Once in the microfluidic channel 13, the orientation of the microparticles 6 cannot change anymore if they are geometrically constrained.

It is possible to change the design of the microparticles 6 to further improve their rotation during sedimentation. For instance, the position, the shape and the size of the protruding means and/or the position, the shape and the size of the code of encoded microparticles may be tuned in order to influence the sedimentation angle, and to make it favorable for landing. It would further be possible to increase the size of the inlet well 14 so as to be able to move the injecting means therein and to land the microparticles 6 ideally one by one.

The method according to the invention is further illustrated by the following examples.

Example 1: Microcarriers with a Diameter of 50 μm

Example 1 uses microcarriers having a disc shape and a diameter of about 50 μm. These microcarriers comprise on their bottom sides an oxide layer and protruding means (spacer).

Example 2: Microcarriers with a Diameter of 30 μm

Example 2 uses microcarriers having a disc shape and a diameter of about 30 μm, these microcarriers comprising on their bottom sides an oxide layer and protruding means (spacer).

The microcarriers of Examples 1 and 2 are injected in a microfluidic channel of an assay device by means of pipette means and by the method according to the invention The following table gives the results of the orientation of the microcarriers within the microfluidic channel.

| Examples | Micro-carrier diameter | Location in the inlet well before entering in the channel | Number of micro-carriers analyzed | Micro-carriers with oxide layer and spacer on top (%) | Micro-carriers and spacer down on the bottom wall (%) |
|---|---|---|---|---|---|
| Example 1 | 50 μm | Sidewall | 32 | 25 | 75 |
| | | | 31 | 24 | 76 |
| Example 2 | 30 μm | Sidewall | 32 | 12.5 | 87.5 |
| | | | 31 | 7.5 | 92.5 |

The last column of the table shows that more than fifty percents of the microcarriers have a correct orientation in the microfluidic channel so that their detection surfaces (located on their bottom sides) can be detected through an observation wall of said microfluidic channel.

Having described the invention, the following is claimed:

1. A method for injecting microparticles into a microfluidic channel by means of injecting means which comprises a tip through which said microparticles are intended to exit when being injected, said microfluidic channel having an end opening out in a sidewall of an inlet well, and the microparticles are not symmetrical about a plane perpendicular to their longitudinal axis and comprise a top side and a bottom side which comprises protruding means, wherein the method comprises the steps of:

a) positioning said tip above at least a zone of said sidewall and at a predetermined distance (d) therefrom, said predetermined distance (d) being in the range of 0.5 mm to 5 mm, wherein the surface of said sidewall being inclined at an angle (γ) of about 10° to 80° with respect to the horizontal plane; and b) injecting the microparticles into said inlet well so that the microparticles come into contact with or in the vicinity of said zone, and then slides on the sidewall before entering said end of the microfluidic channel with their bottom sides facing a bottom wall of the microfluidic channel.

2. The method according to claim 1, wherein the injecting means comprise a liquid sample in which the microparticles are in suspension, said liquid sample having a concentration of microparticles of less than 2000 microparticles per milliliter of liquid sample.

3. The method according to claim 1, wherein the injecting means are moved during injection of the microparticles.

4. The method according to claim 1, wherein, at step a), the injecting means are positioned so that the angle (β) between their longitudinal axis and the sidewall or a longitudinal axis of the sidewall is between 0 to 30°.

5. The method according to claim 1, wherein the bottom wall of the microfluidic channel is connected to a bottom wall of the inlet well.

6. The method according to claim 1, wherein the microparticles are microcarriers.

7. The method according to claim 1, wherein the microparticles have a disc shape and have a diameter of about 1 to 200 μm and a height of about 1 to 50 μm.

8. The method according to claim 1, wherein the microfluidic channel has a height which is less than the diameter and less than twice the thickness of the microparticles.

9. The method according to claim 1, wherein the angle (γ) is about 20° to 70°.

10. The method according to claim 1, wherein the angle (γ) is about 50° to 70°.

11. The method according to claim 6, wherein the microcarriers are encoded microcarriers.

12. The method according to claim 1, wherein the predetermined distance (d) is in the range 0.5 mm to 4 mm.

13. The method according to claim 1, wherein the predetermined distance (d) is in the range 1 mm to 3 mm.

14. A device for performing the method according to claim 1, which comprises:

an assay device comprising at least one microfluidic channel each opening out on a sidewall of an inlet well and having a bottom wall connected to a bottom wall of the inlet well, and a loading station carrying the assay device in a tilted position where the angle between the assay device and a horizontal plane is about 10-80° so that said inlet well is located substantially above said at least one microfluidic channel.

15. The device according to claim 14, wherein the angle between the assay device and a horizontal plane is about 20° to 70°.

16. The device according to claim 14, wherein the angle between the assay device and a horizontal plane is about 20° to 40°.

* * * * *